US005916068A

United States Patent [19]

Chisholm et al.

[11] Patent Number: 5,916,068

[45] Date of Patent: Jun. 29, 1999

[54] VARIABLE RESISTANCE DEVICE

[76] Inventors: Philip Chisholm, One Performance Way, Chapel Hill, N.C. 27514; Giulio Bertolo, Via Velo 47, 35014 Fontaniva (Padova), Italy

[21] Appl. No.: 08/917,391

[22] Filed: Aug. 25, 1997

[51] Int. Cl.[6] ..... A63B 22/06

[52] U.S. Cl. ..... 482/61; 482/112; 188/290; 188/293

[58] Field of Search ..... 482/61, 111–113, 482/57–59; 188/290, 293, 294; 198/58.4, 58.42, 58.43

[56] References Cited

U.S. PATENT DOCUMENTS

| | | | |
|---|---|---|---|
| Re. 34,479 | 12/1993 | Minoura . | |
| D. 264,954 | 6/1982 | Blackburn . | |
| D. 285,426 | 9/1986 | Blackburn et al. . | |
| D. 292,900 | 11/1987 | Blackburn et al. . | |
| D. 298,156 | 10/1988 | Blackburn . | |
| D. 299,225 | 1/1989 | Blackburn . | |
| D. 299,818 | 2/1989 | Blackburn . | |
| D. 306,193 | 2/1990 | Blackburn . | |
| D. 329,035 | 9/1992 | Blackburn et al. . | |
| 2,988,188 | 6/1961 | Tauschech | 192/58.43 |
| 3,373,992 | 3/1968 | Ludeman . | |
| 3,400,796 | 9/1968 | Savins et al. | 192/58.43 |
| 3,442,131 | 5/1969 | Leyten . | |
| 3,494,616 | 2/1970 | Parsons . | |
| 3,498,431 | 3/1970 | Sotaruk | 192/58.43 |
| 3,831,942 | 8/1974 | Del Mar . | |
| 4,152,617 | 5/1979 | Janson . | |
| 4,171,802 | 10/1979 | Stoecker . | |
| 4,186,320 | 1/1980 | Hillman . | |
| 4,441,705 | 4/1984 | Brown . | |
| 4,520,284 | 5/1985 | Wolcott . | |
| 4,602,373 | 7/1986 | Dorfman . | |
| 4,640,449 | 2/1987 | Blackburn . | |
| 4,645,199 | 2/1987 | Bloemendaal . | |
| 4,741,529 | 5/1988 | Bloemendaal . | |
| 4,768,782 | 9/1988 | Blackburn . | |
| 4,775,145 | 10/1988 | Tsuyama . | |
| 4,817,939 | 4/1989 | Augspurger et al. . | |
| 4,822,037 | 4/1989 | Makansi et al. . | |
| 4,826,150 | 5/1989 | Minoura . | |
| 4,853,574 | 8/1989 | Estaque . | |
| 4,979,735 | 12/1990 | Stewart . | |
| 5,026,047 | 6/1991 | Koescoff . | |
| 5,050,865 | 9/1991 | Augspurger et al. . | |
| 5,056,700 | 10/1991 | Blackburn et al. . | |
| 5,080,210 | 1/1992 | Hagiwara | 192/58.42 |
| 5,145,478 | 9/1992 | Minoura . | |
| 5,195,936 | 3/1993 | Mao . | |
| 5,472,392 | 12/1995 | Haan et al. | 482/61 |
| 5,542,507 | 8/1996 | Warchocki et al. | 188/290 |
| 5,611,759 | 3/1997 | Zeh et al. | 482/61 |

FOREIGN PATENT DOCUMENTS

| | | |
|---|---|---|
| 0 176 962 | 4/1986 | European Pat. Off. . |
| 1 279 201 | 6/1972 | United Kingdom . |

*Primary Examiner*—Jerome Donnelly
*Attorney, Agent, or Firm*—Rhodes Coats & Bennett, L.L.P.

[57] ABSTRACT

An apparatus provides variable resistance to rotation and includes a housing having a shaft having a first portion that is rotatable in the housing and a second portion passing outwardly thereof adapted to receive the tire of a bicycle for stationary bicycle exercise. A first body in the housing is mechanically linked to the first portion of the shaft so as to be rotatable within the housing. A second body in the housing is slidably connected to the first portion of the shaft and has flat face opposed to the flat face of the first body. The second body is movable with respect to the first body to result in a variably-sized gap between the opposed faces. A spring located between the housing and the second body biases the second body toward the first body. Further mechanism is provided to permit adjustment of the gap between the first body and the second body, and a viscous fluid in the housing frictionally engages the bodies and provides resistance to their rotation, with the amount of resistance dependent upon the size of the gap.

36 Claims, 7 Drawing Sheets

VARIABLE RESISTANCE DEVICE

FIELD OF THE INVENTION

The present invention relates generally to variable resistance devices, and in the preferred embodiment a braked roller device for cycling training. This type includes a rotating roller which has a substantially horizontal axis and is mounted on a support, a means for detachably anchoring the support to a stand for supporting the rear wheel of a bicycle so that it is raised from the ground and in contact with the roller, and a braking means which is rigidly coupled to the support and acts on the roller to simulate the effort of forward motion.

DESCRIPTION OF THE PRIOR ART

Roller devices for cycle training can be used by professional or amateur athletes and even by ordinary people for sports, hobby, or therapeutic purposes, in enclosed spaces or in any case in static conditions, at any time of the day and regardless of the weather conditions, so as to avoid any limitation or risk linked to road traffic.

Roller devices are known in which the braking means is constituted by a flywheel and by a fan that are keyed to the ends of a roller that is arranged in contact with the driving wheel of the bicycle. This device offers considerable static torque, does not allow correct simulation of the resistance to the stroke of the pedal as speed increases, and is excessively noisy.

In order to obviate these drawbacks, magnetic-type braked rollers have been devised: in these rollers, the braking means is constituted by a disk made of nonmagnetic material that is keyed on the roller and is situated in a magnetic field which is generated, for example, by permanent magnets associated with the support. The characteristic curve of the device is approximately linear up to a speed of approximately 30 km/h and therefore in this range the device is able to simulate the forward motion effort of the cyclist with a certain effectiveness.

However, probably due to the high magnetic leakage, no significant increase in resistance is observed for rotation rates above the one that corresponds to 30 km/h. In practice, the characteristic curve of these braked rollers is of the linear type up to a rotation rate that corresponds to a linear speed of approximately 30 km/h, after which it becomes substantially flat or constant as the rotation rate varies.

Devices with a fluid roller are also known; in these devices, the braking means is constituted by a vaned impeller that is immersed in a viscous fluid, for example a silicone compound, contained in a sealed housing as described in U.S. Pat. No. 5,611,759

One drawback of these known fluid-based devices is the fact that the vane assembly of the impeller has a geometry that is designed to operate correctly in a certain direction of rotation, so that a rotation in the opposite direction would produce a drastically lower resistance. Accordingly, the roller, which is normally supplied in disassembled condition, must be fixed to the stand in a very specific position, which depends on the assigned direction of rotation.

In other conventional fluid-based devices, described for example in U.S. Pat. No. 4,645,199 and U.S. Pat. No. 5,542,507, the impeller does not have vanes but has asymmetrical rotors or indentations on the housing and disk surfaces to continuously vary the resistance through each revolution of the rotor. A fluid-based device having smooth surfaces and bi-directional capabilities is described in co-pending application Ser. No. 08/736,314 of Sartore.

Another drawback of many fluid-based devices is that they do not provide adjustable resistance. In U.S. Pat. No. 4,645,199, an expansion tank and piston are provided to vary the amount of fluid in contact with the impeller, thereby providing variable resistance. This approach has drawbacks including the need for an expansion tank, piston, valve, and other fluid handling parts. Moreover, they are imprecise unless a fluid measuring step is added to the process.

Accordingly, there is a need for a resistance device having the benefits of quiet, bi-directional, high-speed resistance that varies the amount of resistance without the need to pump or measure fluid and provides a convenient and measurable way to immediately change the resistance.

SUMMARY OF THE INVENTION

The present invention fulfills this need by providing an apparatus for providing variable resistance to rotation. The apparatus includes a housing, a shaft having a first portion that is rotatable in the housing and a second portion passing outwardly thereof and arranged to be rotated. The apparatus also includes first and second bodies in the housing mechanically linked to the first portion of the shaft so as to be rotatable within the housing and having opposed faces. One of the bodies is movable with respect to the other to result in a variably-sized gap between the opposed faces. The housing contains a viscous fluid to frictionally engage the bodies and provide resistance to their rotation, with the amount of resistance dependent upon the size of the gap.

In the preferred embodiment, the first and second bodies have substantially smooth surfaces, the first body is substantially disk shaped, and the resistance to rotation for a given gap is substantially the same in both directions of rotation of the shaft. One feature of the preferred embodiment is that the first body has at least one hole therein for receiving a portion of the second body. In addition, the second body is independently positionable with respect to the first body, and the first and second bodies rotate about the first portion of the shaft.

In the preferred embodiment, the second body is biased toward the first body by a spring disposed between the second body and the housing. The second body is connected to a rod that passes through the housing, and the gap between the opposed faces is adjusted by a cam attached to a rod which has a first portion that is outside the housing and a second portion that is inside the housing, the rod being connected to the second body. For the convenience of the user, the gap between the opposing faces may be adjusted by a remotely located control.

In the preferred embodiment, the housing is hermetically sealed and has a plurality of cooling fins on its outer surface. The cooling fins are substantially parallel and are oriented vertically or slightly inclined with respect to the vertical.

In an alternative embodiment, the second portion of the shaft may be adapted to be rotated by a pulley, belt or gear. This would facilitate the use of the apparatus in other types of exercise machinery, such as a treadmill or a bicycle roller device. However, in the preferred embodiment, the second part of the shaft is mounted on a frame and is adapted to receive the tire of a bicycle for stationary bicycle exercise. In addition, a flywheel is attached to the end of the second portion of the shaft opposite the first portion of the shaft.

The invention also provides a method of varying a resistance to rotation including rotating a pair of bodies with opposed faces in a viscous fluid to centrifugally repel the viscous fluid from the centers of the opposed faces toward the peripheries of the faces. In the method of the invention, the faces are spaced apart by a first gap to permit viscous fluid from the periphery to enter between the faces a first distance less than a radius thereof and are then spaced apart by a second gap larger than the first gap to permit viscous fluid from the periphery to enter between the faces a second distance greater than the first distance. This method provides variable frictional drag on the rotation of the bodies from a lesser amount at the first gap to a greater amount at the second gap. The preferred method further includes mechanically linking the pair of bodies to a shaft to resist the rotation of the shaft. In the preferred method, the bodies are rotationally symmetrical, whereby the resistance to rotation is substantially the same in both directions of rotation of the shaft.

The preferred method also includes minimizing the turbulence caused by the rotation of the bodies by providing the bodies with smooth surfaces. The method may further include slidably inserting a portion of one of the bodies into several holes in the other of the bodies to synchronize the rotation of the pair of bodies, while one of the bodies is fixed relative to the shaft and the other body is permitted to move along the shaft. This method includes rotating both of the bodies in the same direction and speed about the shaft to minimize the vibration of the pair of bodies.

The method may also include biasing the pair of bodies toward each other and adjusting a moveable rod attached to one of the bodies to regulate the spacing of the faces apart from each other. Preferably, this includes adjusting the spacing between the faces through a remotely located switch. The preferred method includes enclosing the pair of bodies and the viscous fluid within a housing to contain the fluid, hermetically sealing the housing, and cooling the housing by conducting heat to cooling fins to dissipate the heat generated by the rotation.

In the preferred method, the shaft is mounted on a frame and rotation of the shaft occurs by engagement with a tire of a bicycle used as a stationary bicycle exerciser.

BRIEF DESCRIPTION OF THE DRAWINGS

Further characteristics and advantages will become apparent from the following detailed description of a non-limitative example of embodiment of a variable resistance-generating roller according to the invention, illustrated with the aid of the accompanying drawings, wherein.

DESCRIPTION OF THE PREFERRED EMBODIMENTS OF THE INVENTION

Figure 1:
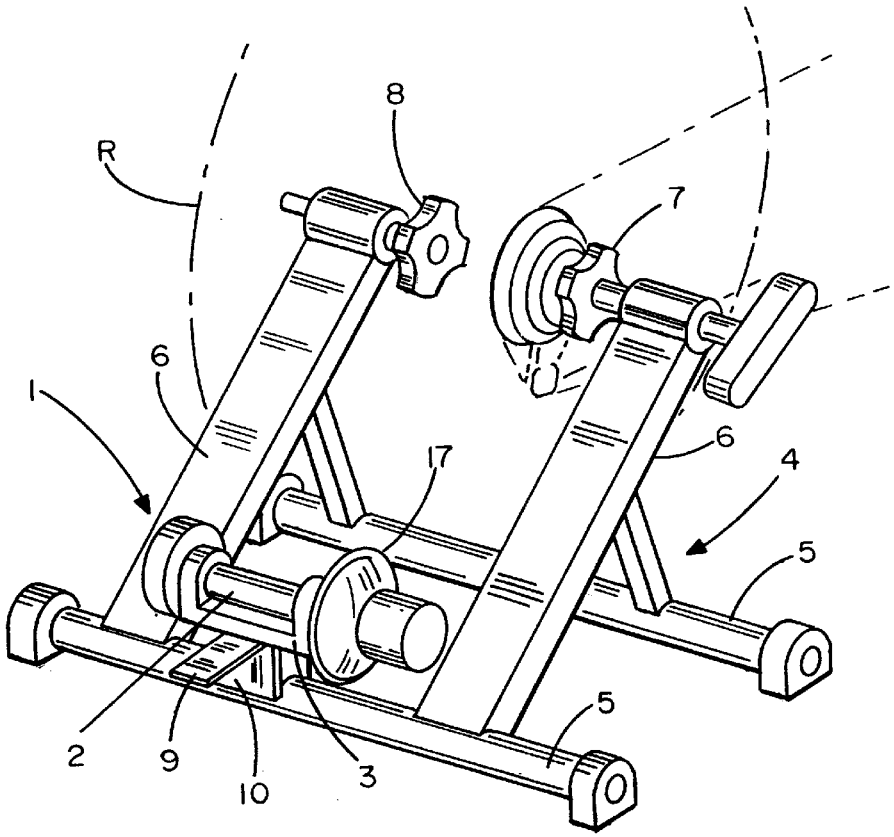
FIG. 1 is a general perspective view of the variable resistance device according to the invention, as mounted in a bicycle exercise apparatus.
Figure 2:
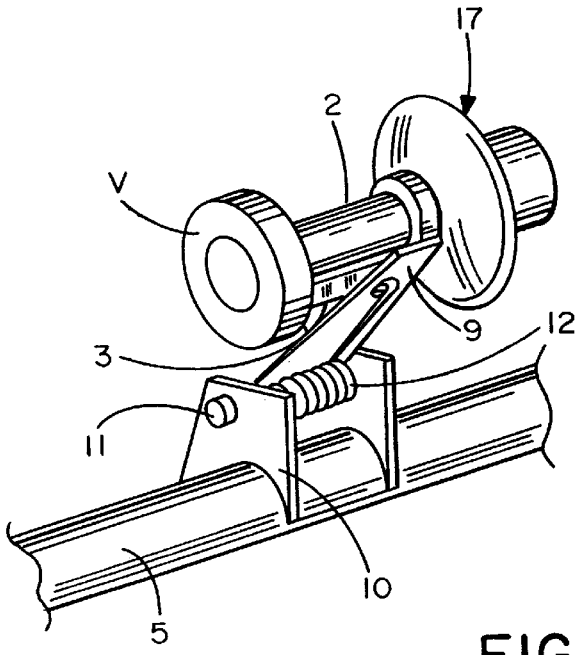
FIG. 2 is a detail perspective view of the bicycle exercise apparatus of FIG. 1, showing in more detail how the variable resistance device is utilized in this application.

With reference to the above figures, a bicycle training braked roller device, generally designated by the reference number 1, essentially includes a roller 2 that has a substantially horizontal axis a and is mounted on a support 3 that can be anchored to a stand 4, made of metal tubes, which supports the rear wheel R of a bicycle so as to keep it raised from the ground and in contact with roller 2.

The stand, which is of a conventional type, can be made of two cross-members 5 with rubber end supports, on which inclined posts 6 are welded which respectively upwardly support a screw clamp 7 and a fixed support 8 for locking the rear wheel R of a bicycle in a position in which it is raised from the ground and is in contact with roller 2.

Support 3 can be anchored to the stand by means of a connecting plate 9 pivoted, by means of a pivot 11, on a fork-like bracket 10 that is rigidly coupled to a cross-member 5. A spiral spring 12, mounted on pivot 11, acts elastically on plate 9, keeping the roller constantly raised and forced against the wheel R.

Roller 2 has a cylindrical part, made for example of steel or reinforced polymeric material, with an outside diameter d, which is fixed to a shaft 13 by means of longitudinal grooves 14. The shaft 13 is, in turn, mounted on two end roller bearings 15 and 16 that are anchored to support 3.

A variable resistance device according to the invention, generally designated by the reference numeral 17, is provided at one end of support 3 to simulate resistance to forward motion. Flywheel mass V is installed at the end of shaft 13 that lies opposite to the variable resistance device, in order to even out the motion.

Figure 3:
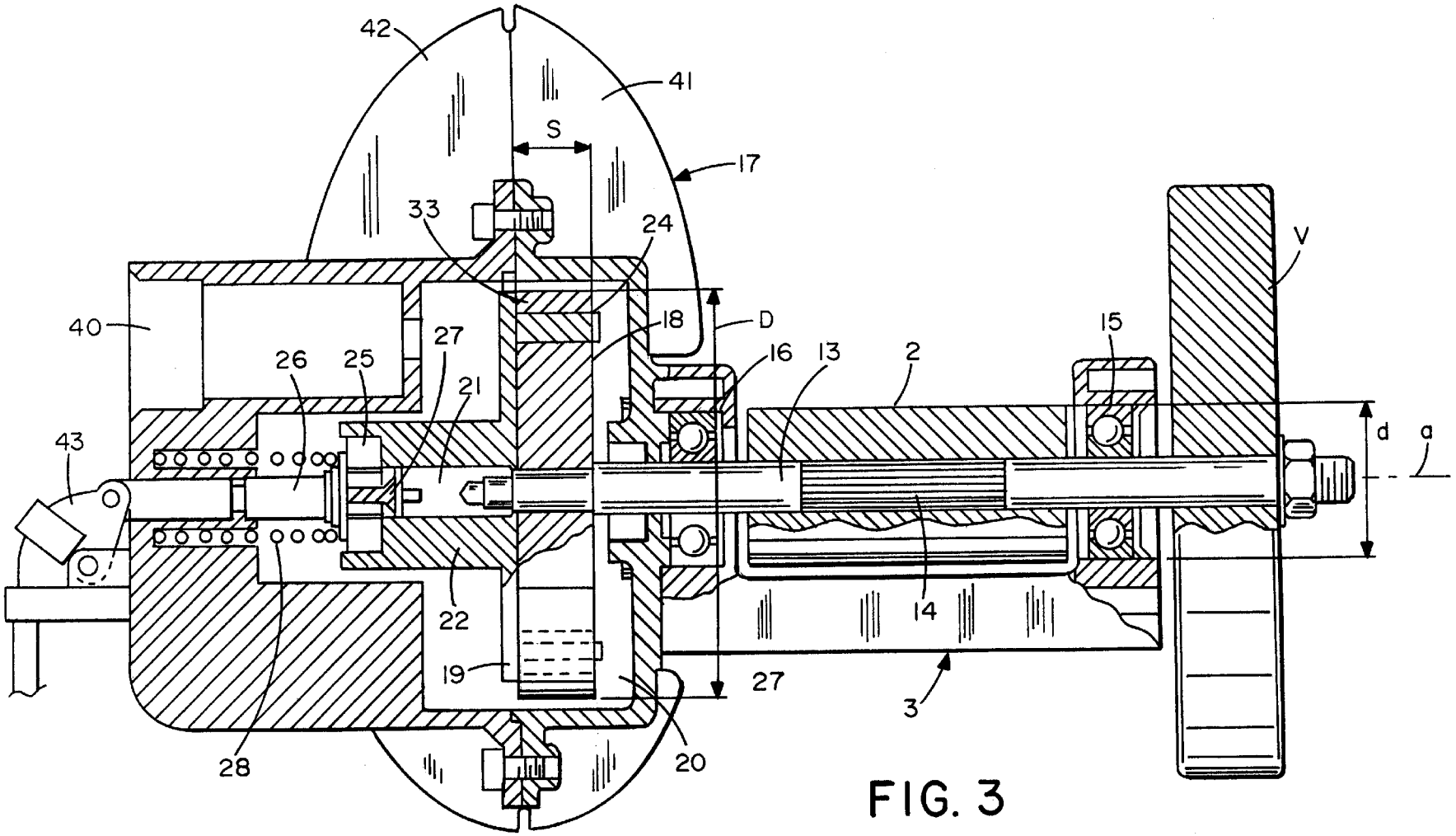
FIG. 3 is a partially sectional view of the braked roller device containing the variable resistance device of the invention, at the setting of minimum resistance, taken along an axial plane.

Referring to FIG. 3, variable resistance device 17 includes a first body 18 that is keyed to one end of axle 13 and a second body 19 that slides over a slotted extension 21 of shaft 13. Slotted extension 21 is screwed onto the tapered and threaded end of shaft 13. Bodies 18 and 19 are accommodated in a hermetically sealed chamber 20, which is partially filled with a viscous fluid. The amount of fluid that fills chamber 20 can vary, depending on the intensity of the desired braking effect. Generally, however, once the fluid is introduced to the chamber 20, its quantity is not changed.

During the rotation of shaft 13, the fluid is centrifugally propelled outward along the surfaces of bodies 18 and 19, and tends to circulate in chamber 20. By virtue of the geometry of bodies 18 and 19, which are symmetrical with respect to the axis a, it is possible to use both directions of rotation without any change to the braking effect.

Body 18 is disk shaped and may be made of metallic or plastic material, having a diameter of, for example, 50 to 100 mm and a thickness of approximately 15 mm, with. parallel and flat faces, a circular peripheral surface, and a central hole. Body 18 is fixed to shaft 13 by any desired means, such as by slotted extension 21. Body 18 has four through holes 24 parallel to the axis a of roller 2. The holes are arranged along a circumference that is concentric to the axis a, in diametrically opposite and equidistant positions.

Second body 19 is a made of cast zinc or aluminum (other suitable materials may be used) and comprises a central disk having an elongated collar 22 on one side and four pegs 23 on the other side, with a central hole to receive slotted extension 21. Pegs 23 are configured to mate with holes 24 in body 18. At the end of collar 22 distal from the central disk of body 19, a bearing 25 is held in place by a rod and spring plate assembly 26 and screw 27.

A spring 28 biases body 19 toward body 18 by pressing on the spring plate assembly 26. During rotation of body 19, the spring plate assembly is isolated from the rotation by the bearing 25.

Figure 4:
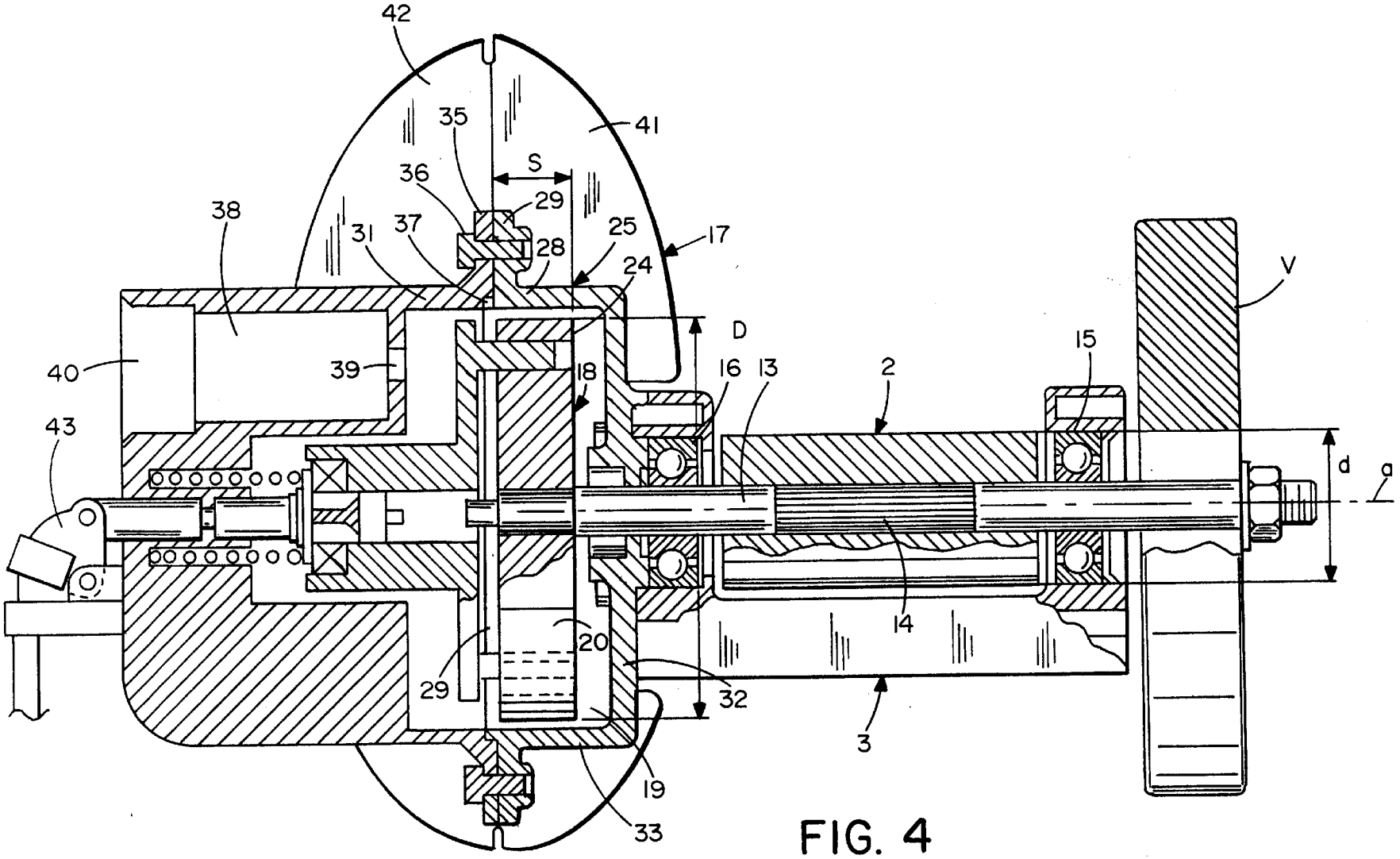
FIG. 4 is a partially sectional view of the braked roller device containing the variable resistance device of the invention, at a setting of greater resistance than that in FIG. 3, taken along an axial plane.
Figure 7:
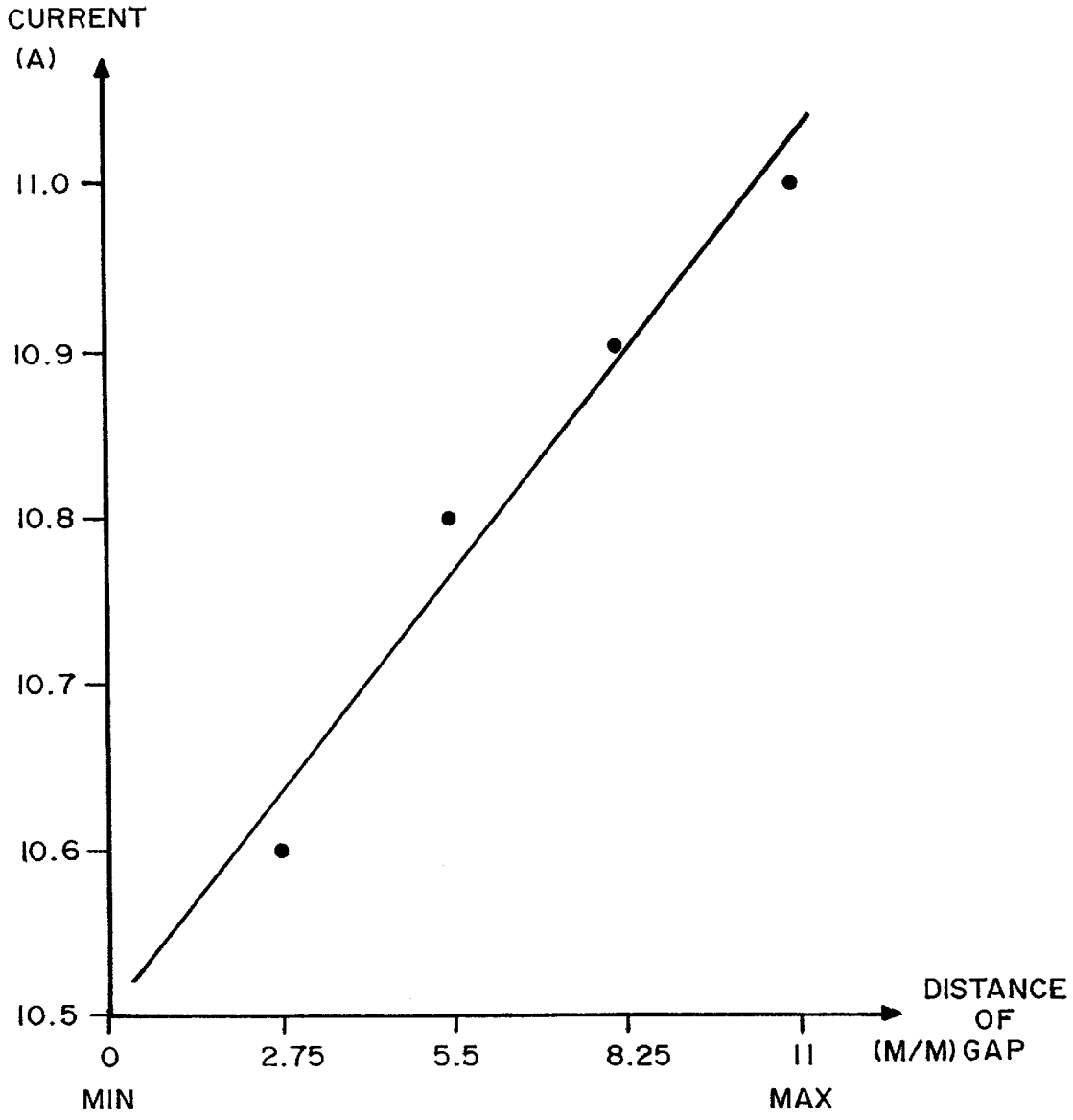
FIG. 7 plots the curves of the operation of the device according to the invention, at various distances between the faces of the rotating bodies, for a constant rotational speed.

Referring to FIG. 4, the distance between body 18 and body 19 may be varied by withdrawing a portion of rod 26 from chamber 20. The resulting gap 29 between bodies 18 and 19 permits viscous fluid to frictionally resist the rotation of the bodies over a greater surface area than that of FIG. 3. The resistance varies depending on the size of the gap 29, as shown in FIG. 7.

The chamber 20 is preferably formed by two facing housing members 30 and 31. The first housing member 30 has a side wall 32 that is substantially flat and a peripheral wall 33 that has an approximately cylindrical shape, with a slightly larger diameter than body 18 and with a connecting flange 34.

The second housing member 31 has a substantially cylindrical shape and has a peripheral flange 35 that can be coupled to flange 34 of first housing member 30 by means of screws 36 and sealing o-ring 37. A filling hole 38 communicates with the chamber 20 by means of a central hole 39, and is provided with a screw-on plug 40 for introducing the fluid to the chamber. The fluid may be a silicone fluid, such as those known in the art.

Figure 5:
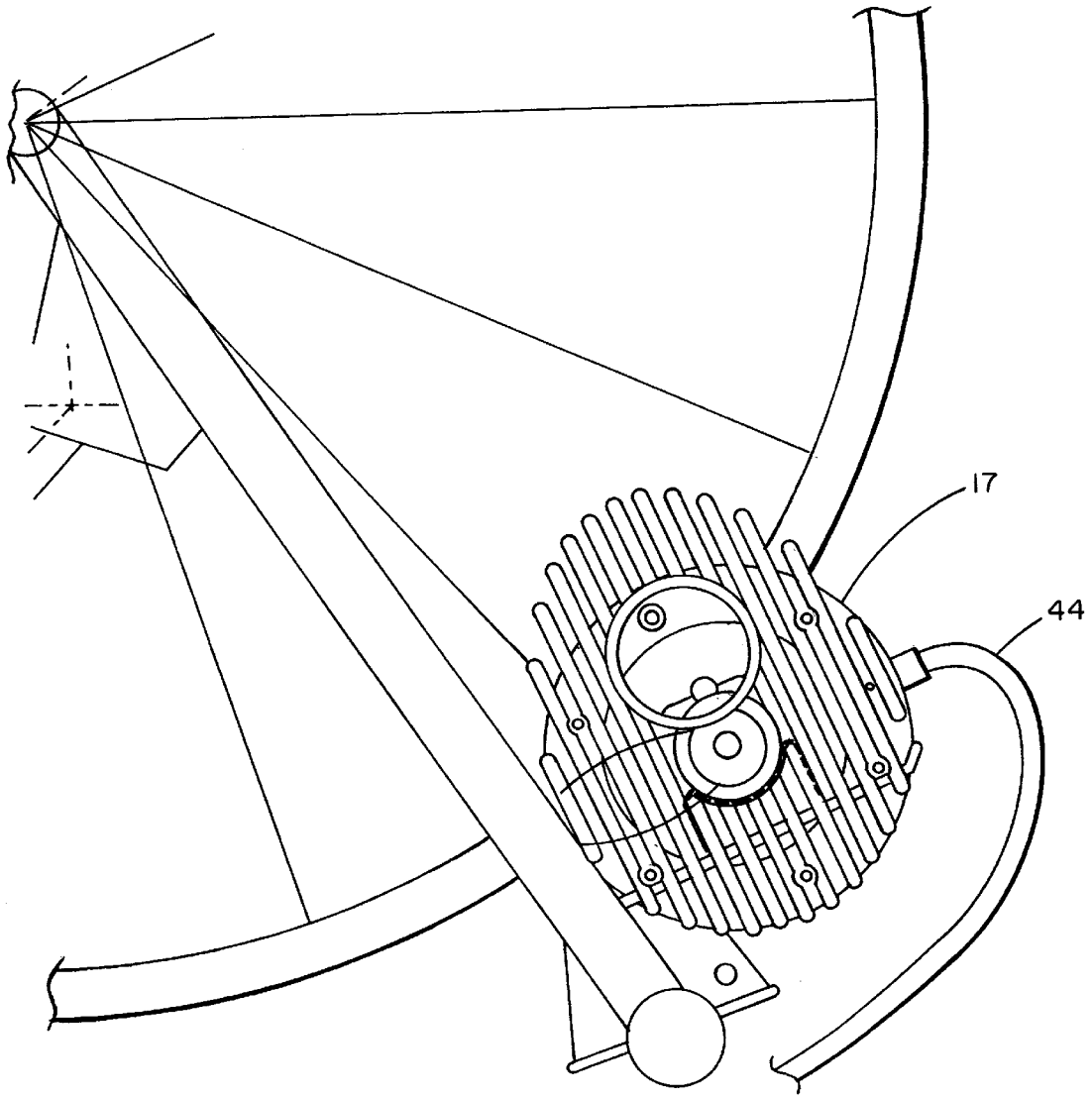
FIG. 5 is a side view of the braked roller device containing the variable resistance device mounted on a frame, to which a bicycle wheel is coupled.

Both housing members 30 and 31 have respective rows of substantially flat and parallel cooling fins 41 and 42 on their outer surfaces to conduct and radiate heat. Preferably, fins 41 and 42 are arranged in an approximately vertical or slightly inclined direction when mounted on the stand 4, so as to facilitate heat dissipation and cooling of the viscous fluid. Furthermore, the outer edges of the cooling fins 41 and 42 may be shaped so as to form a particular oval structure, as shown in FIGS. 4 and 5.

Rod 26 extends from the inside to the outside of housing member 31. Attached to the outside of housing member 31, a cam assembly 43 controls the depth of penetration of rod 26 into the chamber 20. In the preferred embodiment, cam assembly 43 is attached to a remote selectively positionable switch on the handlebar of the bicycle (not shown) by way of cable 44. The rider of the bicycle is able to use the remote switch to adjust the amount of resistance to the rotation of the bicycle wheel by varying the gap between bodies 18 and 19.

Figure 6:
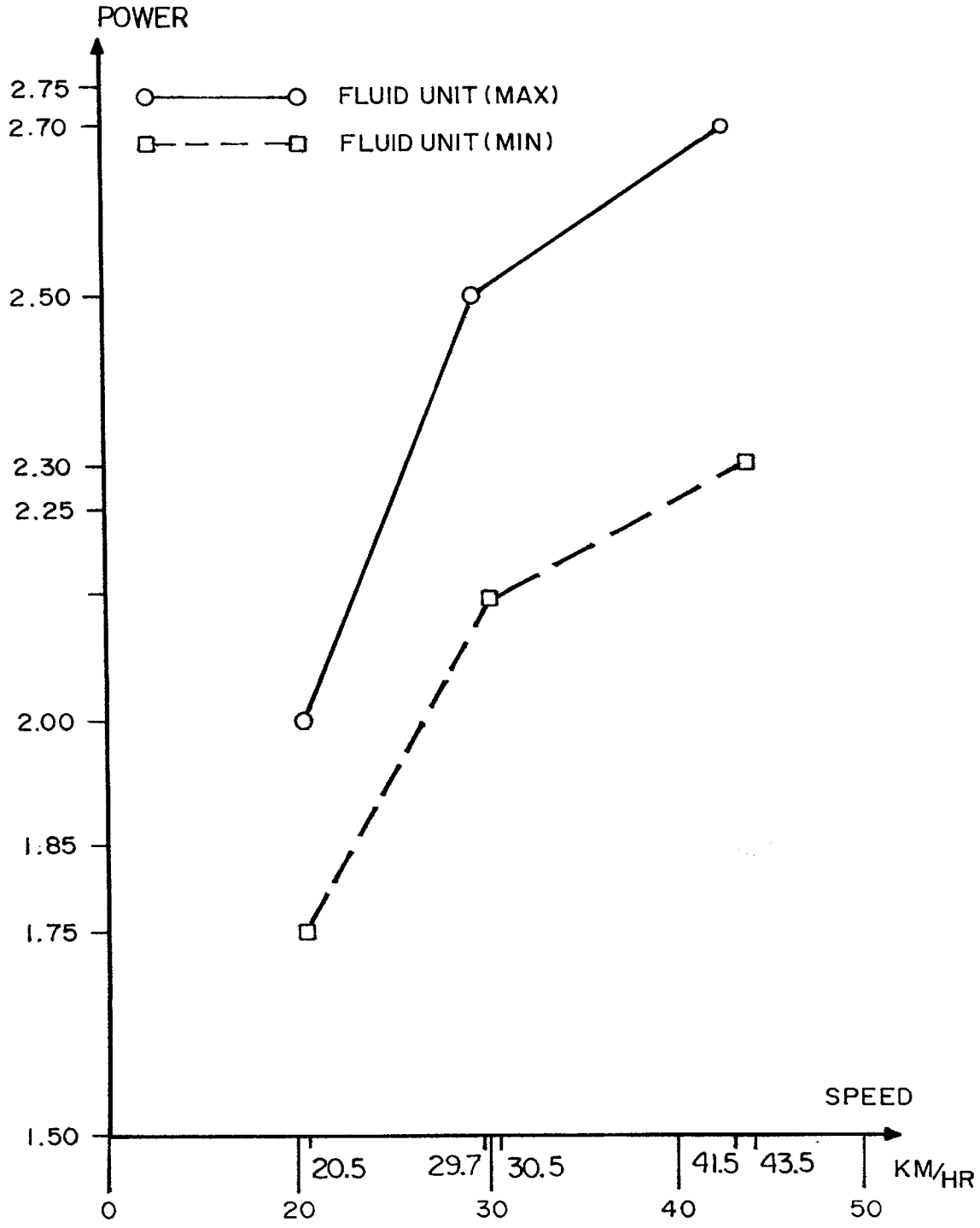
FIG. 6 plots the curves of the operation of the device according to the invention, at minimum and maximum resistance, over a range of rotational speeds.

FIG. 6 plots the curves of the operation of the device according to the invention, at minimum and maximum resistance, over a range of rotational speeds. It shows the generally linear variation in resistance force on the vertical axis vs speed of rotation on the horizontal axis.

Figure 8:
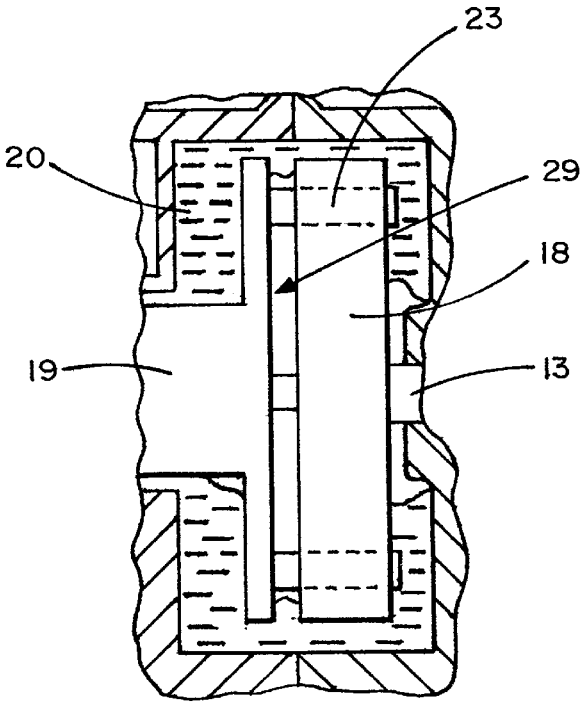
FIG. 8 is a detail of the side view of the variable resistance device according to the invention, illustrating the estimated locations of fluid creating frictional drag on the bodies during rotation with a small gap between the bodies.
Figure 9:
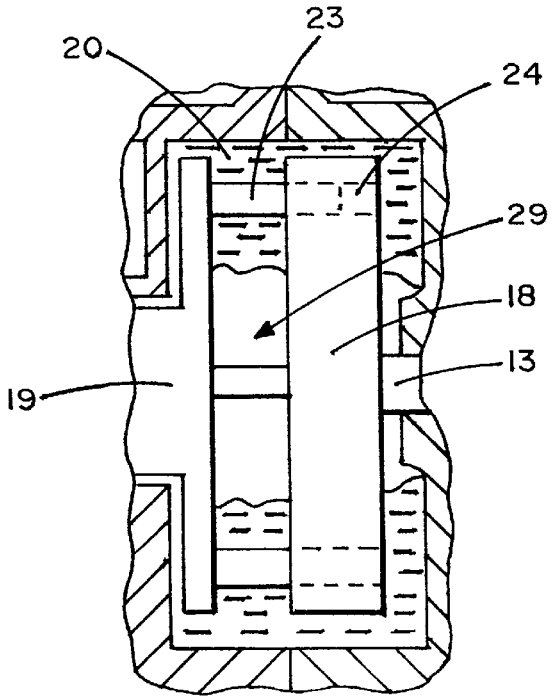
FIG. 9 is a detail of the side view of the variable resistance device according to the invention, illustrating the estimated locations of fluid creating frictional drag on the bodies during rotation with a large gap between the bodies.

FIG. 7 plots the curves of the operation of the device according to the invention, at various distances between the faces of the rotating bodies, for a constant rotational speed. It illustrates the fact that the resistance increases as the gap between the rotating bodies increases. This is believed to occur because the fluid that is near the center of the bodies rotates with the bodies creating no friction as long a the gap is below a certain distance, which is generally greater than most of the gap sizes provided for in the apparatus. The amount the fluid that rotates along with the bodies decreases with gap size, and the non-rotating fluid provides additional frictional drag on the bodies. This phenomenon is illustrated in FIGS. 8 and 9, which show the estimated location of fluid creating frictional drag on the disk surfaces during operation of the device.

Other mechanisms to adjust the gap between the bodies 18 and 19 may be substituted. For example, the spring may be used to urge the bodies apart instead of together, with the cam assembly arranged to drive them together in opposition to the spring. Also, the camming mechanism may be substituted by a screw mechanism. Various other alternative mechanisms may be used also. Numerous variations on the preferred embodiment disclosed hereinabove may occur to those in the art and the foregoing description of the preferred embodiment is not intended to be limiting, but rather exemplary of the invention, which is more particularly pointed out in the claims.

What is claimed is:

1. An apparatus for providing variable resistance to rotation comprising a housing, a shaft having a first portion that is rotatable in said housing and a second portion passing outwardly thereof to a frame adapted to a frame adapted to receive the tire of a bicycle, so that tire rotation will cause said shaft to rotate, first and second bodies in said housing mechanically linked to said first portion of said shaft so as to be rotatable within said housing and having opposed faces, one of said bodies being movable with respect to the other to result in a variably-sized gap between said opposed faces, and a viscous fluid in said housing to frictionally engage said bodies and provide resistance to their rotation, with the amount of resistance dependent upon the size of the gap.

2. An apparatus as claimed in claim 1 wherein said first and second bodies have substantially smooth surfaces.

3. An apparatus as claimed in claim 1 wherein said first body is substantially disk shaped.

4. An apparatus as claimed in claim 1 wherein the resistance to rotation for a given gap is substantially the same in both directions of rotation of said shaft.

5. An apparatus as claimed in claim 1 wherein said first body has at least one hole therein for receiving a portion of said second body.

6. An apparatus as claimed in claim 1 wherein said second body is independently positionable with respect to said first body.

7. An apparatus as claimed in claim 1 wherein said first and second bodies rotate about said first portion of said shaft.

8. An apparatus as claimed in claim 1 wherein said second body is biased toward said first body by a spring disposed between said second body and said housing.

9. An apparatus as claimed in claim 1 wherein said second body is supported by a rod that passes through said housing.

10. An apparatus as claimed in claim 1 wherein the gap between said opposed faces is adjusted by a cam attached to a rod which has a first portion that is outside said housing and a second portion that is inside said housing, said rod being connected to said second body.

11. An apparatus as claimed in claim 1 wherein said gap between said opposing faces may be adjusted by a remotely located switch.

12. An apparatus as claimed in claim 1 wherein said housing is hermetically sealed.

13. An apparatus as claimed in claim 1 wherein said housing has a plurality of cooling fins on its outer surface.

14. An apparatus as claimed in claim 13 wherein said cooling fins are substantially parallel and are oriented vertically or slightly inclined with respect to the vertical.

15. An apparatus as claimed in claim 1 wherein said second portion of said shaft is adapted to be rotated by a pulley, belt or gear.

16. An apparatus as claimed in claim 1 wherein a flywheel is attached to the end of said second part of said shaft opposite said first part of said shaft.

17. An apparatus as claimed in claim 16 wherein said second body is independently positionable with respect to said first body.

18. An apparatus as claimed in claim 17 wherein the gap between said opposed faces is adjusted by a cam attached to a rod which has a first portion that is outside said housing and a second portion that is inside said housing, said rod being connected to said second body.

19. An apparatus for providing variable resistance to rotation comprising a housing having a plurality of cooling fins on its outer surface that are substantially parallel and slightly inclined with respect to the vertical, a shaft having a first portion that is rotatable in said housing and a second portion passing outwardly thereof that is adapted to receive the tire of a bicycle for stationary bicycle exercise, a frame supporting said second portion of said shaft, a flywheel attached to the end of said second portion of said shaft opposite said first part of said shaft, a first body in said housing that is mechanically linked to said first portion of said shaft so as to be rotatable within said housing and having a substantially flat face, a second body in said housing that is slidably connected to said first portion of said shaft and having a substantially flat face opposed to said flat face of said first body, said second body being movable with respect to said first body to result in a variably-sized gap between said opposed faces, a spring in said housing to bias said second body toward said first body, a rod which has a first portion that is outside said housing and a second portion that is inside said housing, said rod being in communication with said second body, a cam attached to said first portion of said rod to adjust the gap between said first body and said second body, and a viscous fluid in said housing to frictionally engage said bodies and provide resistance to their rotation, with the amount of resistance dependent upon the size of the gap.

20. A method of varying a resistance to rotation in a stationary bicycle exercise comprising placing a tire of a bicycle in contact with a shaft mounted on a frame rotating the bicycle tire to rotate the shaft and a pair of bodies with opposed faces linked to the shaft and housed in a housing containing a viscous fluid, to centrifugally faces toward the peripheries of the faces, spacing the faces apart by a first gap to permit viscous fluid from the periphery to enter between the faces a first distance less than a radius thereof and spacing the faces apart a second gap larger than the first gap to permit viscous fluid from the periphery to enter between the faces a second distance greater than the first distance, whereby the frictional drag on the rotation of the bodies is varied from a lesser amount at the first gap to a greater amount at the second gap.

21. A method as claimed in claim 20 further comprising mechanically linking the pair of bodies to a shaft to resist the rotation of the shaft.

22. A method as claimed in claim 21 further comprising providing rotationally symmetrical bodies whereby the resistance to rotation is substantially the same in both directions of rotation of the shaft.

23. A method as claimed in claim 20 further comprising minimizing the turbulence caused by the rotation of the bodies by providing the bodies with smooth surfaces.

24. A method as claimed in claim 20 further comprising slidably inserting a portion of one of the bodies into a hole in the other of the bodies to synchronize the rotation of the pair of bodies.

25. A method as claimed in claim 21 further comprising fixing one of the bodies relative to the shaft and permitting the other body to move along the shaft.

26. A method as claimed in claim 21 further comprising rotating both of the bodies in the same direction and speed about the shaft to minimize the vibration of the pair of bodies.

27. A method as claimed in claim 20 further comprising biasing the pair of bodies toward each other and adjusting a moveable rod attached to one of the bodies to regulate the spacing between the faces.

28. A method as claimed in claim 20 further comprising adjusting the spacing between the faces through a remotely located switch.

29. A method as claimed in claim 20 further comprising enclosing the pair of bodies and the viscous fluid within a housing to contain the fluid.

30. A method as claimed in claim 29 further comprising conducting heat in the housing to a plurality of cooling fins on the outer surface of the housing to dissipate the heat generated by said rotation.

31. A method as claimed in claim 29 further comprising hermetically sealing the housing.

32. A method as claimed in claim 21 further comprising enclosing the pair of bodies and the viscous fluid within a hermetically sealed housing to contain the fluid.

33. A method as claimed in claim 32 further comprising conducting heat in the housing to a plurality of cooling fins on the outer surface of the housing to dissipate the heat generated by said rotation.

34. A method as claimed in claim 33 further comprising biasing the pair of bodies toward each other and adjusting a moveable rod attached to one of the bodies to regulate the spacing between the faces.

35. A method as claimed in claim 34 further comprising slidably inserting a portion of one of the bodies into a hole in the other of the bodies to synchronize the rotation of the pair of bodies.

36. A method of varying a resistance to rotation in a stationary bicycle exercise comprising mechanically linking a first disk shaped body having a substantially smooth surface and a substantially circular face and a second body having an opposing substantially circular face to a shaft, slidably inserting a portion of one of the bodies into a hole in the other of the bodies to synchronize the rotation of the pair of bodies, biasing the pair of bodies toward each other and attaching a moveable rod to one of the bodies to regulate the spacing of the faces apart from each other, hermetically sealing the pair of bodies and a viscous fluid within a housing having a plurality of cooling fins on the outer surface of the housing, mounting the shaft on a frame to receive a the tire of a bicycle to enable it to be used as a component of a stationary bicycle exerciser, placing a tire of a bicycle in contact with the shaft spacing the faces apart by a first gap to permit viscous fluid from the periphery to enter between the faces a first distance less than a radius thereof, rotating the bicycle tire to rotate the shaft and the pair of bodies in the viscous fluid, to centrifugally repel the viscous fluid from the centers of the opposed faces toward the peripheries of the faces, and spacing the faces apart a second gap larger than the first gap to permit viscous fluid from the periphery to enter between the faces a second distance greater than the first distance, whereby the frictional drag on the rotation of the bodies is varied from a lesser amount at the first gap to a greater amount at the second gap.

* * * * *

UNITED STATES PATENT AND TRADEMARK OFFICE

CERTIFICATE OF CORRECTION

PATENT NO. : 5,916,068

DATED : June 29, 1999

INVENTOR(S) : Philip Chisholm et al.

It is certified that error appears in the above-identified patent and that said Letters Patent is hereby corrected as shown below:

In Claim 1, Column 6, line 27, delete the second occurance of "to a frame adapted".

In Claim 36, line 2, "exercise" should be --exerciser--.

Signed and Sealed this

Twenty-fifth Day of January, 2000

*Attest:*

*Attesting Officer*

*Acting Commissioner of Patents and Trademarks*